US007367248B2

(12) United States Patent
Ruffner

(10) Patent No.: US 7,367,248 B2
(45) Date of Patent: May 6, 2008

(54) SCREWTOP OPENER

(75) Inventor: Walter Ruffner, Jolly Harbour (AG)

(73) Assignee: MOHA Moderne Haushaltwaren AG, Zollikofen (CH)

( * ) Notice: Subject to any disclaimer, the term of this patent is extended or adjusted under 35 U.S.C. 154(b) by 0 days.

(21) Appl. No.: 11/585,359

(22) Filed: Oct. 23, 2006

(65) Prior Publication Data

US 2007/0157766 A1 Jul. 12, 2007

(30) Foreign Application Priority Data

Oct. 21, 2005 (CH) ..... 1694/05

(51) Int. Cl.
*B67B 7/18* (2006.01)
*B25B 7/04* (2006.01)

(52) U.S. Cl. ..... 81/3.44; 81/3.42; 81/357

(58) Field of Classification Search ..... 81/3.44, 81/3.42, 3.37, 357, 3.4, 3.07, 361; D8/39, D8/40

See application file for complete search history.

(56) References Cited

U.S. PATENT DOCUMENTS 746,195 A * 12/1903 Stork ..... 81/3.42
1,967,960 A * 7/1934 McNemar ..... 81/3.42
2,454,489 A * 11/1948 Sullivan ..... 81/3.42
2,651,957 A * 9/1953 Phillips ..... 81/3.36
2,719,444 A * 10/1955 Zeller ..... 81/3.42
2,931,258 A 4/1960 Ronning, Jr.
3,343,432 A * 9/1967 Nagy ..... 81/3.42
3,822,614 A * 7/1974 Kovacevic ..... 81/3.42
5,083,482 A * 1/1992 Floyd ..... 81/3.44
6,854,361 B2 * 2/2005 Vandergaw ..... 81/3.44

* cited by examiner

*Primary Examiner*—Hadi Shakeri
(74) *Attorney, Agent, or Firm*—Pauley Petersen & Erickson

(57) ABSTRACT

A screwtop opener with a first handle and a second handle which can be pivoted in relation to the first handle. A first clamping jaw is formed on the first handle and a second clamping jaw is formed on the second handle. A screwtop can be grasped by the two clamping jaws. A distance between the clamping jaws can be reduced by pivoting the two handles against each other. In accordance with this invention, a first clamping jaw is embodied on a straightedge, which can be pushed into the first handle and can be arrested in a multitude of positions with respect to the first handle. Thus, it is possible to achieve a short linear extension of the screwtop opener without foregoing the comfort of being able to also grasp and open large screwtops.

18 Claims, 4 Drawing Sheets

SCREWTOP OPENER

BACKGROUND OF THE INVENTION

1. Field of the Invention

This invention relates to a screwtop opener having a first handle pivotable with respect to a second handle.

2. Discussion of Related Art

A screwtop opener is known from U.S. Pat. No. 2,931,258. This screwtop opener includes two elements, which can be displaced with respect to each other, a longer first handle arranged on a bottom having clamping jaws that project downward, and a shorter second handle arranged on a top having clamping jaws that project laterally beyond the sides of the first handle and downward from the first handle. Both handles are U-shaped in cross section, wherein an opening of the U faces downward. Thus, each of the handles has two clamping jaws formed by the legs of the U shaped profile. In connection with the clamping jaws of the first handle, the legs are longer at the ends, such as in the area of the clamping jaws, than over the remainder of the length of the handle. Thus, they protrude downward and their front ends facing toward the lower end of the handle can be brought into contact with a top. The ends at the front of the legs of the other handle can be brought into contact with the screwtop. The rim of the top can be clamped between the four ends of the legs. Thus, a number of notches are provided on the top of the first handle, respectively into which a tooth on the second handle can be hooked. Depending on the diameter of the top to be opened, the second handle can be hooked closer to the front or closer to the end of the first handle. The second handle should be hooked at a location at which the second handle extends upward at an angle of approximately 15 to 45 degrees with respect to the first handle. Both handles then can be pushed toward each other using one hand, because the angle between the two handles is reduced. Thus, the clamping jaws of the second handle and the clamping jaws of the first handle approach each other and clamp the top between them.

A different screwtop opener is known from U.S. Pat. No. 5,083,482, and has a traction bar, on which a clamping jaw is displaceably seated and thus can be fixed in place at a plurality of locations corresponding to the different top sizes. The traction bar is fixedly connected with a handle. A second handle is hinged on the traction bar, with which a clamping jaw is connected. By pushing the two handles together in the manner of a pair of pliers, the two clamping jaws move toward each other. Thus it is possible to grip a top.

Both known described screwtop openers have a disadvantage that a total length of the device must be longer than a sum of the lengths of the handles and of the largest diameter of a top which can be opened.

SUMMARY OF THE INVENTION

It is one object of this invention to provide as compact as possible a screwtop opener, particularly which is not limited to top sizes which can be grasped by the known openers.

This object is achieved with a screwtop opener having a first handle and a second handle which can be pivoted with respect to the first handle. A first clamping jaw is formed on the first handle, and a second clamping jaw is formed on the second handle. A screwtop can be grasped by the two clamping jaws, and a distance between the clamping jaws can be reduced by pivoting the two handles. However, in contrast to the prior art, the first clamping jaw is formed on a straightedge which can be pushed into the first handle and can be arrested in a multitude of positions with respect to the first handle.

This allows the straightedge to be pushed into the handle and thus reduce the length of the screwtop opener, practically to the handle length. A handle length of approximately 17 cm makes it possible to pull out a straightedge arranged inside it by approximately 12 cm. Thus it is possible to open screwtops of approximately 1 to 12 cm with a screwtop opener having an entire length merely approximately 20 cm. The length of the handle extending past or beyond the screwtop, and thus the rotating leverage, is always the same, regardless of the top size.

The first and second handles can be pivoted with respect to each other around an axis. The handles are suitable arranged one behind the other in the direction of the axis. Thus, the two handles can be brought into a congruent position by being pivoted around the axis. In this position the peripheries or silhouettes of the two handles with the same contours are congruent. The two handles can form a closed overall shape in this position. The longitudinal axes can extend parallel.

As soon as their longitudinal axes no longer extend parallel with each other, the handles are in an open position.

If both clamping jaws are arranged on the same side of the pivot axis at a distance from the axis, and if the pivot axis extends parallel with respect to the axis of rotation of the top to be opened, a lever arm results between the clamping jaws of the second handle and the pivot axis between the handles. Thus, in the event of a force exerted on the lever arm, the second handle tends to be pivoted with respect to the first handle. So that this pivoting tends to lead to clamping of the screwtop between the clamping jaws, the pivot direction of the second handle for clamping a top is preferably identically oriented with the screwing direction of the top, for opening the top.

A ratchet strip is preferably formed on a straightedge, which works together with a resiliently seated actuating knob so that the actuating knob is pressed into engagement with the ratchet strip by the spring force, but can be brought out of contact with the ratchet strip by the exertion of a force opposite the spring force. To achieve this in a simple manner, the straightedge is suitably conducted through an opening in the actuating knob, a compression spring is provided between an underside of the actuating knob and the second handle, and a top of the actuating knob is accessible from the top of the first handle. This allows the pushing of the actuating knob for bringing it out of engagement with the ratchet strip in order to be able to shift the straightedge in this manner.

Preferably, the straightedge is seated to be linearly displaceable inside the first handle and can be usefully brought into a retracted position when the handles are pivoted together, in which the straightedge is in engagement with the second handle. Thus the handles are arrested against each other in the closed or pivoted-together position.

A ring can be usefully formed on each one of both handles, which two rings match each other and together define the pivot axis. The outer ring forms the rim, and the inner ring forms an axis arranged therein.

Thus the straightedge is advantageously guided through slit openings in both rings, wherein the slit openings in the ring of the second handle are of such dimensions that they permit the pivoting of the ring of the second handle with respect to the ring of the first handle around the pivot axis. Thus the handles are fastened to each other by the straightedge, but pivoting is also possible.

The contact faces of the clamping jaws at the second handle and on the straightedge can be formed in one piece with the clamping jaws, or by metal inserts in the parts made of plastic. The clamping jaws themselves can be embodied in one piece with the handle or the straightedge.

The handles can be resiliently supported against each other, so that they are pushed into an open position by the spring force.

The spring causing this is preferably arranged in the second handle. An extension is formed on the first handle, which projects into the second handle and acts together with the spring.

BRIEF DESCRIPTION OF THE DRAWINGS

This invention is explained in detail in view of an exemplary embodiment represented in the drawings, wherein.

DETAILED DESCRIPTION OF THE INVENTION

Figure 1:
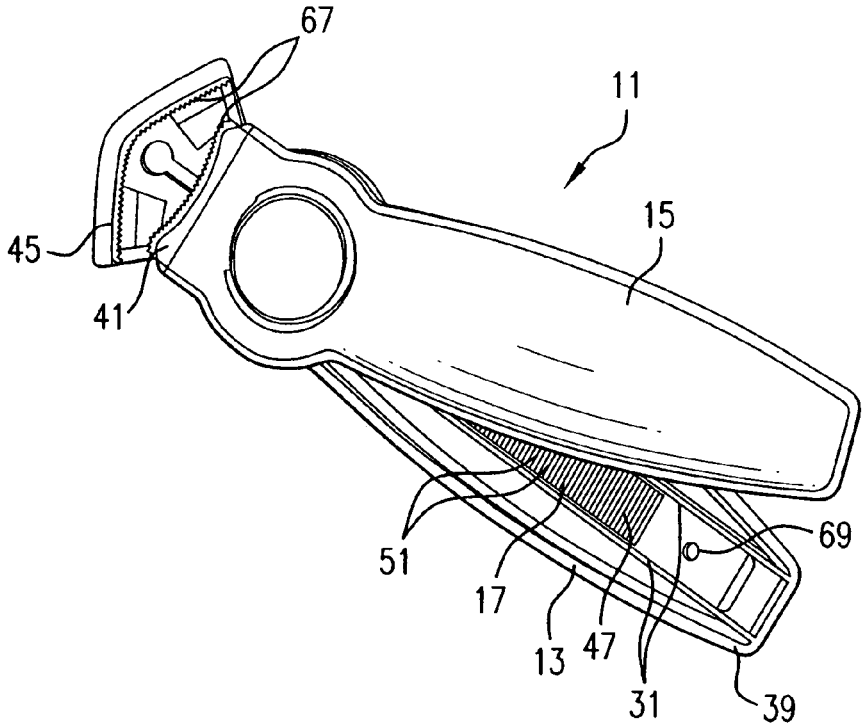
FIG. 1 is a perspective view from below of a screwtop opener.
Figure 2:
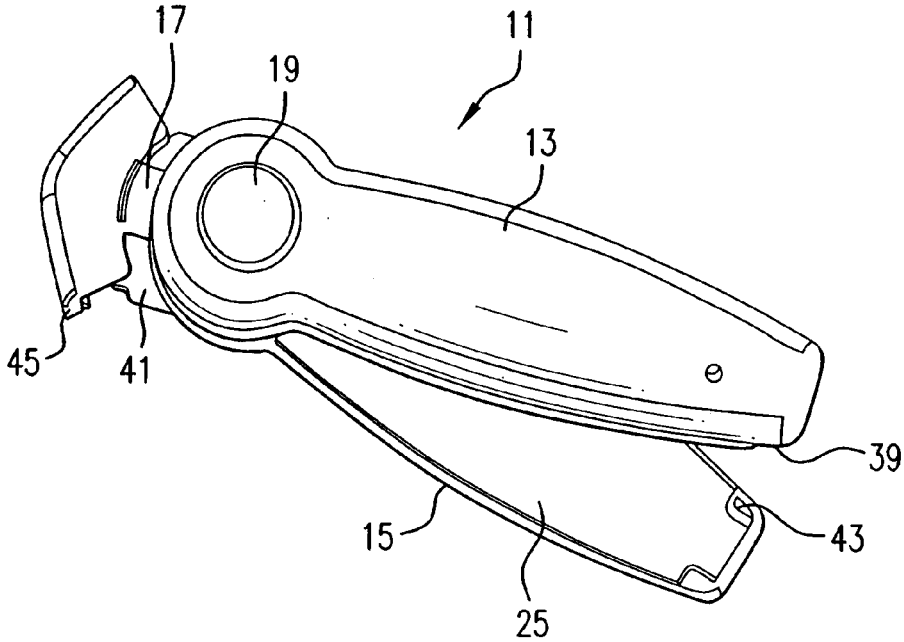
FIG. 2 is a perspective view from above on the screwtop opener.
Figure 3:
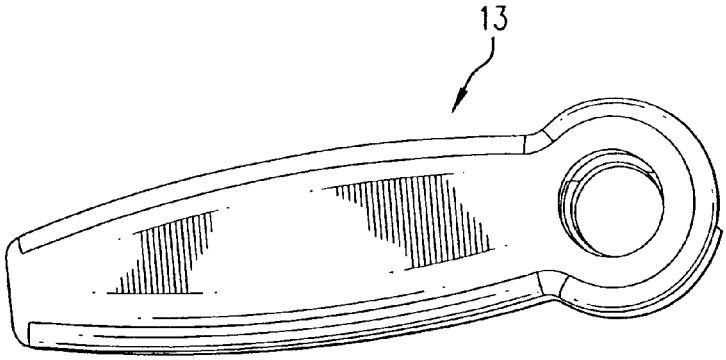
FIG. 3 is a view from above on the first handle.
Figure 4:
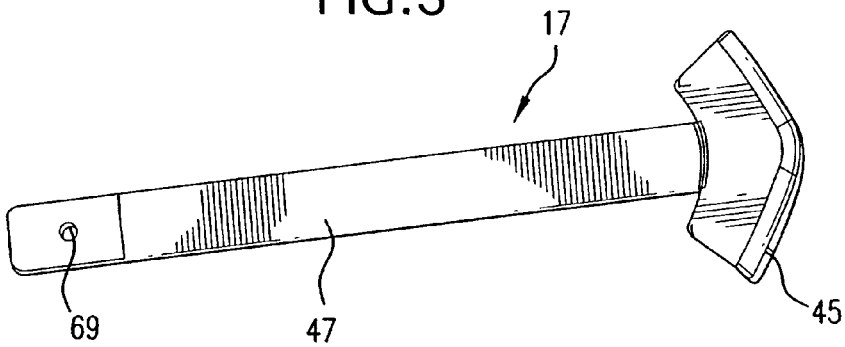
FIG. 4 is a view from above on a straightedge with a first clamping jaw.

The screwtop opener 11 shown in the drawings comprises the following elements.

Figure 5:
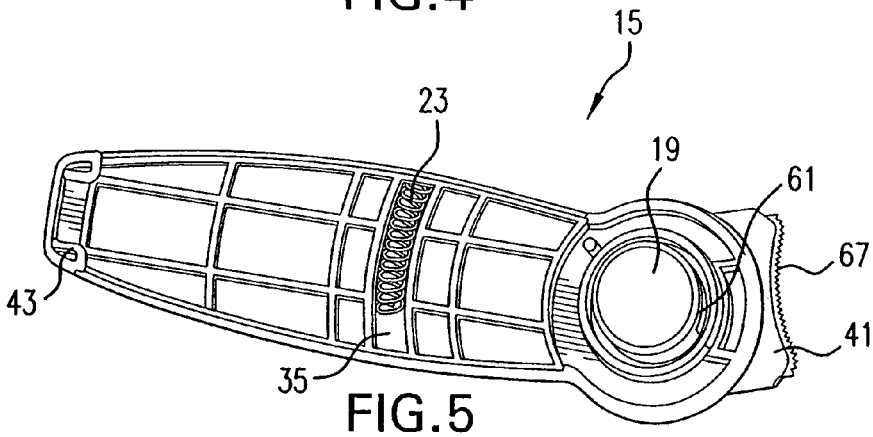
FIG. 5 is a view from above on an inside of the second handle with the second clamping jaw.
Figure 6:
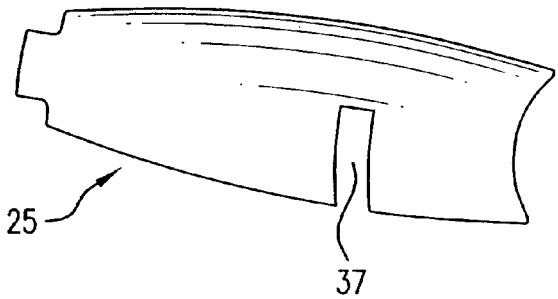
FIG. 6 is a view from above on a cover strip which closes off an inside of the second handle.
Figure 7:
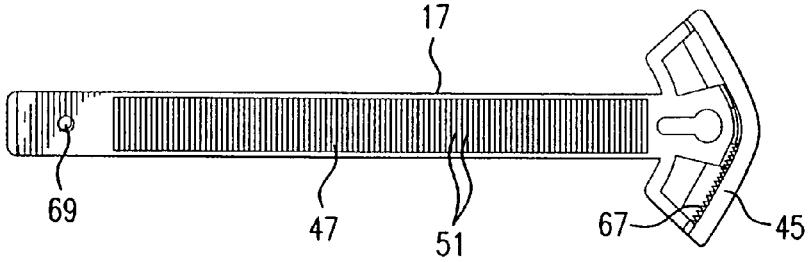
FIG. 7 is a view from below on the straightedge with the first clamping jaw.
Figure 10:
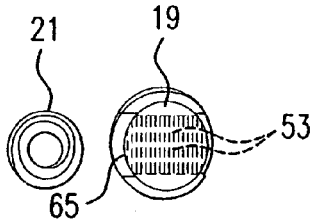
FIG. 10 is a view from below on an actuating knob with a compression spring.
Figure 11:
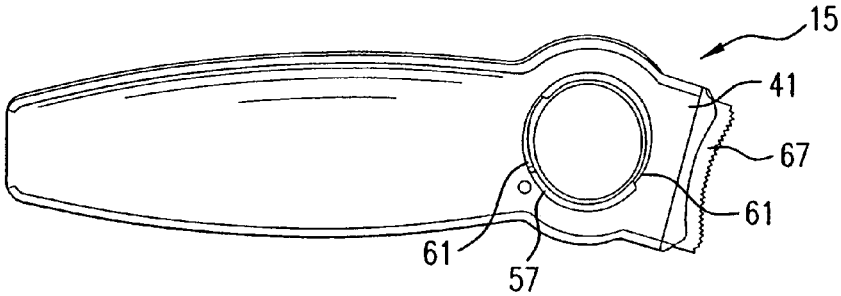
FIG. 11 is a view from below on the second handle with the second clamping jaw.
Figure 12:
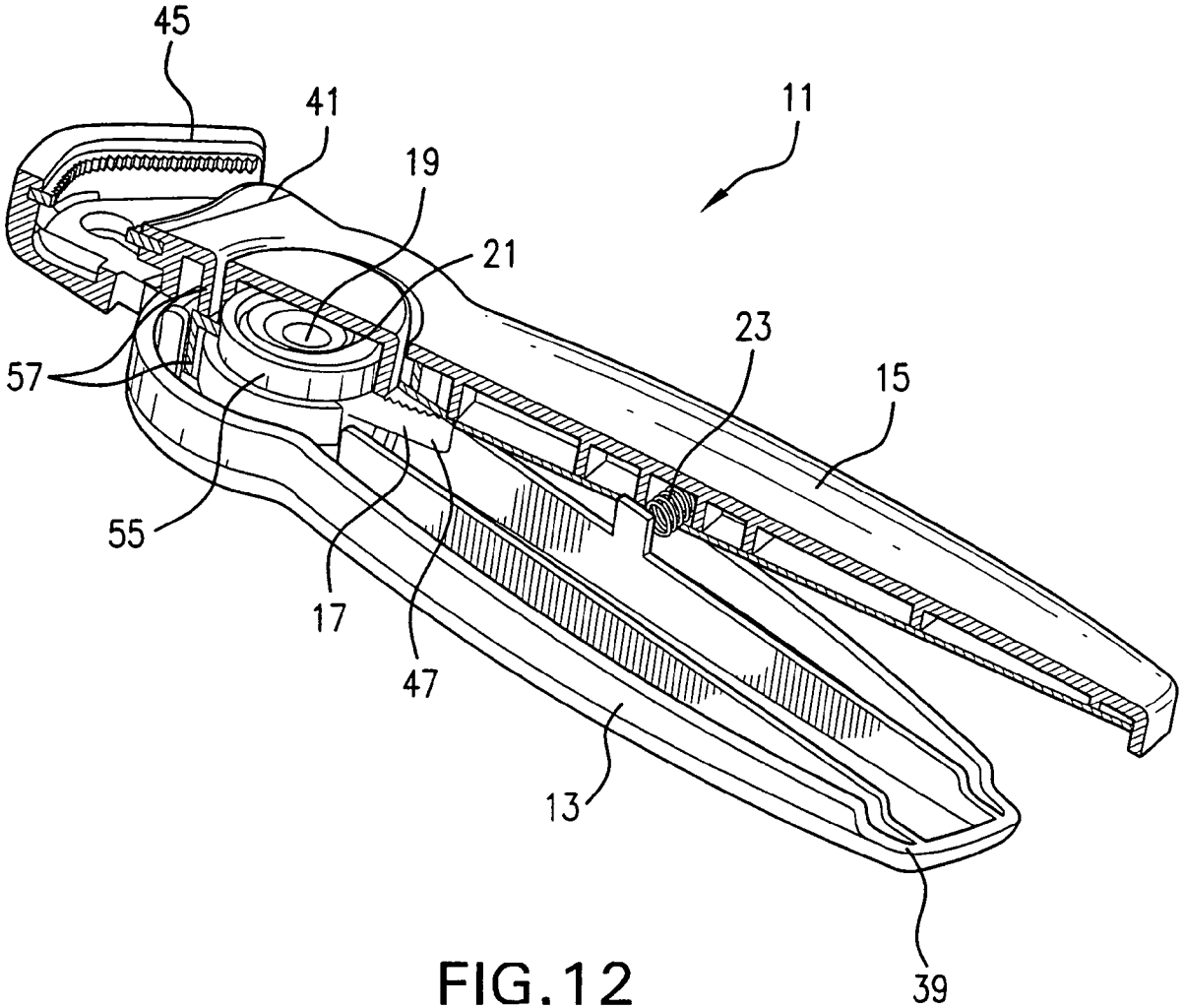
FIG. 12 is a perspective plan view of the screwtop opener with the second handle represented in a partial sectional view.

A first handle 13, a second handle 15, a straightedge 17, an actuating knob 19 and two springs, namely a first, short compression spring 21, as shown in FIG. 10, of a large diameter for acting on the actuating knob 19 by a spring tension, and an elongated second compression spring 23, as shown in FIGS. 5 and 12, of lesser diameter for prestressing the two handles 13, 15 against each other. A cover strip 25 can cover an inside of the second handle 15 and maintain the second compression spring 23 captive in or within the handle 15.

Figure 8:
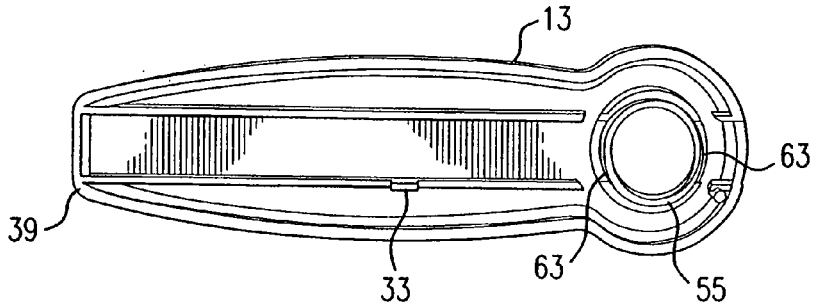
FIG. 8 is a view from below of the inside of the first handle.
Figure 9:
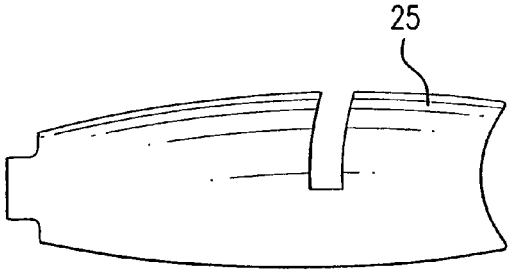
FIG. 9 shows an inside of a cover strip.

The straightedge 17 is displaceably guided in the first handle 13 in a guide element 31. A protruding stop 33, such as shown in FIG. 8, is formed on the handle 13, which extends into the second handle 15 and act together with the second compression spring 23 in the second handle. The handle 13 has a cutout at the handle end of the first handle, so that the end of the straightedge 17 in its entirely retracted position projects from the handle 13 in the area of or near the cutout 39. Thus, working together with the second handle, the straightedge 17 can arrest the two handles in a closed position.

A chamber 35 is formed in the second handle 15, into which the second compression spring 23 is placed. The chamber 35 is conducted in an arc of a circle around the pivot axis between the two handles and is only partially covered by the cover strip 25, which thus leaves a pivot area 37 open, within which the stop 33 can be pivoted. On the other side of a pivot axis between the two handles 13, 15, the second handle 15 supports a second clamping jaw 41. An arresting knob 43 is formed on the handle end of the second handle 15, which works together with the straightedge when the straightedge is completely pushed into the first handle 13 in order to fix the handles in place in the closed position. In the closed position, the contours of the two handles 13, 15 are aligned with respect to each other. The clamping jaw 41 is not arranged axially with respect to the longitudinal axis of the handle, but is instead angled-off by a maximal pivot angle between the two handles. In an open position of the two handles, the clamping jaw 41 can be positioned exactly opposite the other clamping jaw 45 of the straightedge 17.

The first clamping jaw 45 is formed on the straightedge 17. The clamping jaw 45 constitutes or forms a curved cross bar in a shape of a letter T, the stem of which is constituted or formed by an elongated strip 47. The clamping jaw 45 protrudes past or beyond the underside of the strip, so that the strip 47 can rest on a cover and the clamping jaw 45 can grasp an edge of the cover from the side. A corrugation is provided on an underside of the strip. The corrugation can be designed with teeth so that the teeth 51, when working together with the non-actuated actuating knob 19, prevent the straightedge from being pulled out of the first handle 13. Thus, the teeth can be designed perpendicular with respect to the clamping jaw 45, but obliquely descending in the other direction.

Teeth 53 corresponding to the teeth 51 can also be formed on the actuating knob 19. In FIG. 10, the teeth 53 are represented in dashed lines and are inclined in the other direction, so that the teeth 51 of the rod and the teeth 53 of the actuating knob can engage each other.

The first handle 13 has a ring 55 around the actuating knob 19, which forms a type of a shaft. The ring 55 forming a shaft is enclosed by a second ring 57 formed on the second handle 16. Thus the second ring 57 forms a type of a rim. The first ring 55 engages the second ring 57 and is pivotably seated in it. Thus the two handles can be pivoted around each other about a geometric pivot axis (not represented) defined by the rings 55, 57. The rod 47 of the straightedge 17 located in the interior of the first handle extends through both rings 55 and 57. For allowing the pivoting of the two handles with respect to each other, the penetration opening 61 in the second ring 57 is designed broader than would be necessary for the mere penetration of the rod 47. The penetration openings 63 in the first ring 55 cannot be pivoted with respect to the rod, and thus their width corresponds to the width of the rod 47.

Because both rings 55, 57 are closed underneath and on top of the rod 47, the handles 13, 15 cannot be removed from each other when the rod 47 is inserted. The height of the penetration openings 61, 63 is merely slightly less than the height of the rod.

A penetration opening 65 for the rod 47 is also formed in the actuating knob 19. The penetration opening 65 has a width corresponding to the rod width, but is designed higher by one actuating height than the rod height. The actuating knob can be displaced by pushing on it perpendicularly with respect to the rod direction and parallel with respect to the pivot axis for bringing the teeth 53 into and out of engagement with the teeth 51.

The actuating knob 19 has a tooth arrangement on an inside of the penetration opening 65. So that this tooth arrangement can be provided in an injection molding or molding part, the actuating lever comprises an upper part and a lower part.

Small metallic toothed plates 67 are inserted or cast into the clamping jaws 41, 45, so that the contact face of the clamping jaws can grip the edge of the top. If the screwtop opener 11 is made of metal, the contact faces can be formed directly on the clamping jaws and not on the small plates, because such metallic inserts can then be omitted. Alternatively, it is possible to provide adhesive contact faces made of rubber or a rubber-like material.

For example, the screwtop opener is constructed as follows. The second compression spring 23 is inserted into the second handle 15 and the inside of the handle is covered with the cover strip 25. In this way, the chamber 35 is closed to such an extent that the second compression spring is captured therein. Now the second handle 15 is placed on the first handle 13. During this the rings 55, 57 mesh with each other. The stop 33 is introduced through the opening in the cover strip 25 into the chamber 35, so that it comes into contact with the end of the compression spring 23 seated therein. Now, the first compression spring 21 is inserted through the first handle 13 into the inner ring 55. Then the first compression spring 21 is covered with the actuating knob 19. While introducing the actuating knob 19 care must be taken to correctly align the tooth arrangement. Now, the actuating knob 19 is pushed and the rod 47 of the straightedge 17 is inserted into the first handle 13 and pushed through the two rings 55, 57 and the actuating knob 19. Finally, for securing the straightedge 17, an arresting pin at the end of the rod 47 can be pushed or screwed into a hole 69 provided there. However, the arresting pin must not protrude out of the corrugated side of the rod 47, but instead must protrude out of the non-corrugated side of the rod 47.

The screwtop opener can be employed as follows. The straightedge 17 is released by pushing the actuating knob and can therefore be extended. Now the straightedge 17 is placed on a screwtop and is again pushed back as far as possible into the first handle 13. Now the two handles 13, 15 are pivoted with respect to each other. Thus, the clamping jaw which is angled off with respect to the longitudinal handle axis is pivoted out of the position of rest, an opened position of the two handles, into the active position. In the process, the distance between the two clamping jaws 41, 45 is reduced. The screwtop is thus clamped and can now be turned off the container by simultaneously pressing on the two handles 13, 15.

Swiss Patent Document No. CH-01694/05, the priority document corresponding to this invention, and its teachings are incorporated, by reference, into this specification.

What is claimed is:

1. A screwtop opener (11) having a first handle (13) and a second handle (15) pivotable with respect to the first handle (13), wherein a first clamping jaw (45) is supported on the first handle (13), a second clamping jaw (41) is formed on the second handle (15), a screwtop can be grasped by the screwtop opener (11) with the first and second clamping jaws (41, 45), a distance between the clamping jaws (41, 45) is reduced by pivoting the first and second handles (13, 15) against each other, the screwtop opener (11) comprising: the first clamping jaw (45) formed on on a straightedge (17) pushable into the first handle (13) and arrestable in a multitude of positions with respect to the first handle (13), the first handle (13) and the second handle (15) pivotable with respect to each other about an axis and arranged one behind another in a direction of the axis, the clamping jaws (41, 45) arranged on a same side of the axis at a distance from the axis, and the axis extends perpendicularly with respect to a cover plane defined by the clamping jaws (41, 45), wherein a pivot direction of the second handle (15) for clamping a top is oriented in a same direction as a screwing direction of the top for opening the top, and a ratchet strip (51) embodied on the straightedge (17) which works together with a resiliently seated actuating knob (19) so that the actuating knob (19) is pushed into engagement with the ratchet strip (51) by a spring force and can be brought out of engagement with the ratchet strip (51) by exerting a force opposite the spring force.

2. The screwtop opener in accordance with claim 1, wherein the straightedge (17) is seated inside the first handle (13) linearly displaceable and is moveable into a pushed-in position when the first and second handles (13, 15) are pivoted together and the straightedge (17) is in engagement with the second handle (15).

3. The screwtop opener in accordance with claim 2, wherein a ring (55, 57) is respectively formed on the first and second handles (13, 15), and the rings (55, 57) fit into each other and together define a pivot axis.

4. The screwtop opener in accordance with claim 3, wherein the straightedge (17) is introduced through slit openings (61, 63) in the rings (55, 57), the slit openings (61) in the ring (57) of the second handle (15) are dimensioned to permit pivoting of the ring (57) of the second handle (15) with respect to the ring (55) of the first handle (13) about the pivot axis.

5. The screwtop opener in accordance with claim 4, wherein the straightedge (17) passes through an opening (65) in the actuating knob (19), a compression spring (23) is positioned between an underside of the actuating knob (19) and the second handle (15), and a top of the actuating knob (19) is accessible from a top of the first handle (13).

6. The screwtop opener in accordance with claim 5, wherein the second clamping jaw (41) on the second handle (15) has a metallic insert (67) in the handle (15) which is made of plastic.

7. The screwtop opener in accordance with claim 6, wherein the first clamping jaw (45) on the straightedge (17) has a small metallic plate (67) in the straightedge (17) which is made of plastic.

8. The screwtop opener in accordance with claim 7, wherein the first clamping jaw (45) is made in one piece with the straightedge (17).

9. The screwtop opener in accordance with claim 8, wherein the second clamping jaw (41) is made in one piece with the second handle (15).

10. The screwtop opener in accordance with claim 9, wherein the first and second handles (13, 15) are resiliently supported on each other so that the first and second handles (13, 15) are pushable into an opened position by the spring force.

11. The screwtop opener in accordance with claim 10, wherein a spring (23) is arranged on the second handle (15), and a stop (33) is formed on the first handle (13) which extends into the second handle (15) and acts together with the spring (23).

12. The screwtop opener in accordance with claim 1, wherein a ring (55, 57) is respectively formed on the first and second handles (13, 15), and the rings (55, 57) fit into each other and together define a pivot axis.

13. The screwtop opener in accordance with claim 1, wherein the straightedge (17) passes through an opening (65) in the actuating knob (19), a compression spring (23) is positioned between an underside of the actuating knob (19) and the second handle (15), and a top of the actuating knob (19) is accessible from a top of the first handle (13).

14. The screwtop opener in accordance with claim 1, wherein the second clamping jaw (41) on the second handle (15) has a metallic insert (67) in the handle (15) which is made of plastic.

15. The screwtop opener in accordance with claim 1, wherein the first clamping jaw (45) on the straightedge (17) has a small metallic plate (67) in the straightedge (17) which is made of plastic.

16. The screwtop opener in accordance with claim 1, wherein the first clamping jaw (45) is made in one piece with the straightedge (17).

17. The screwtop opener in accordance with claim 1, wherein the second clamping jaw (41) is made in one piece with the second handle (15).

18. The screwtop opener in accordance with claim 1, wherein the first and second handles (13, 15) are resiliently supported on each other so that the first and second handles (13, 15) are pushable into an opened position by the spring force.

* * * * *